United States Patent [19]

Schlameus et al.

[11] Patent Number: 4,888,140

[45] Date of Patent: Dec. 19, 1989

[54] METHOD OF FORMING FLUID FILLED MICROCAPSULES

[75] Inventors: Herman W. Schlameus; Chel W. Lew, both of San Antonio, Tex.; Donald M. Atkinson, West Haven, Conn.

[73] Assignee: Chesebrough-Pond's Inc., Greenwich, Conn.

[21] Appl. No.: 13,315

[22] Filed: Feb. 11, 1987

[51] Int. Cl.[4] ..... A61J 5/04

[52] U.S. Cl. ..... 264/4.3; 264/4.1; 264/4.4

[58] Field of Search ..... 264/4.1, 4.3, 4.4

[56] References Cited

U.S. PATENT DOCUMENTS

| | | | |
|---|---|---|---|
| 3,092,553 | 6/1963 | Fisher et al. | 167/82 |
| 3,173,878 | 3/1965 | Reyes | 264/4.6 |
| 3,389,194 | 6/1968 | Somerville | 264/4 |
| 3,423,489 | 1/1969 | Arens et al. | 264/4 |
| 3,565,559 | 2/1971 | Sato et al. | 424/37 |
| 3,779,942 | 12/1973 | Bolles | 252/316 |
| 3,790,497 | 2/1974 | Sato et al. | 252/316 |
| 4,251,195 | 2/1981 | Suzuki et al. | 425/6 |
| 4,422,985 | 12/1983 | Morishita | 264/4.4 |
| 4,426,337 | 1/1984 | Suzuki et al. | 264/4 |
| 4,481,157 | 11/1984 | Morishita et al. | 264/4.1 |
| 4,622,244 | 11/1986 | Lapka | 427/213.32 |

OTHER PUBLICATIONS

Concise Chemical and Technical Dictionary, 4th ed., New York, Chemical Publishing Co., 1986, pp. 528, 1054.

Goodwin, J. T. et al, "Physical Methods for Preparing Microcapsules" in: Vandegaer, J. E., ed., Microencapsulation Processes and Applications (New York, Plenum Press, 1974), pp. 155–163.

*Primary Examiner*—John F. Terapane
*Assistant Examiner*—Gary L. Geist
*Attorney, Agent, or Firm*—Melvin H. Kurtz

[57] ABSTRACT

The invention is a process for preparing round, fluid filled microcapsules by the simultaneous extrusion, of core and shell material from coaxially aligned and concentric extrusion nozzles into a surrounding carrier fluid moving in the direction of the extrusion wherein a surfactant having affinity with the carrier fluid is added to the carrier fluid.

When the carrier fluid is an oil based carrier, a lipophilic emulsifier such as a sorbitan monoester of a fatty acid can be used.

6 Claims, 1 Drawing Sheet

METHOD OF FORMING FLUID FILLED MICROCAPSULES

BACKGROUND OF THE PRESENT INVENTION

1. Field of the Present Invention

The present invention is an improved method for making fluid filled microcapsules.

2. Description of the Prior Art

In the microencapsulation field, it is known to prepare fluid filled microcapsules by use of a submerged extrusion nozzle configuration in which a concentric extrusion nozzle is mounted in a duct through which an inert, immiscible carrier fluid flows. Filler and shell material are extruded from the nozzle into the carrier fluid to form the desired microcapsules. Descriptions of this general type of technique are contained in Microencapsulation: Processes and Applications, edited by Jan E. Vandegaer, Plenum Press, New York, 1973, page 161, and in U.S. Pat. No. 3,389,194 to G. R. Somerville, the latter being incorporated herein by reference. It has been found that under certain process conditions, the integrity of the shell of the microcapsule formed by this technique is compromised so that leakage of fluid filler material occurs.

U.S. Pat. No. 3,423,489 to R. P. Arens et al. relates to a microencapsulation technique in which a carrier fluid is not utilized. This patent indicates that the shell thickness increases as the interfacial tension between the fill and shell is decreased. It teaches that the interfacial tension can often be reduced by the addition of a surfactant to the fill liquid.

SUMMARY OF THE PRESENT INVENTION

The present invention relies upon the corporation of an effective amount of a surfactant into the carrier fluid, rather than the fill material, in the general type of procedure shown in U.S. Pat. No. 3,389,194 to G. R. Somerville. The incorporation of surfactant in the liquid carrier possesses certain advantages over using the surfactant in either the fill material or the shell material, particularly when the microcapsule is intended for ingestion. The placement of a surfactant in the liquid carrier material insures that no appreciable amounts of surfactant residue will reside in either the microcapsule or the liquid fill for the capsule so as to be ingested thereafter.

DESCRIPTION OF THE DRAWINGS

An apparatus for practicing the process of the present invention is shown in the attached FIGURE, which forms a portion of the present specification.

DETAILED DESCRIPTION OF THE PRESENT INVENTION

Figure 1:
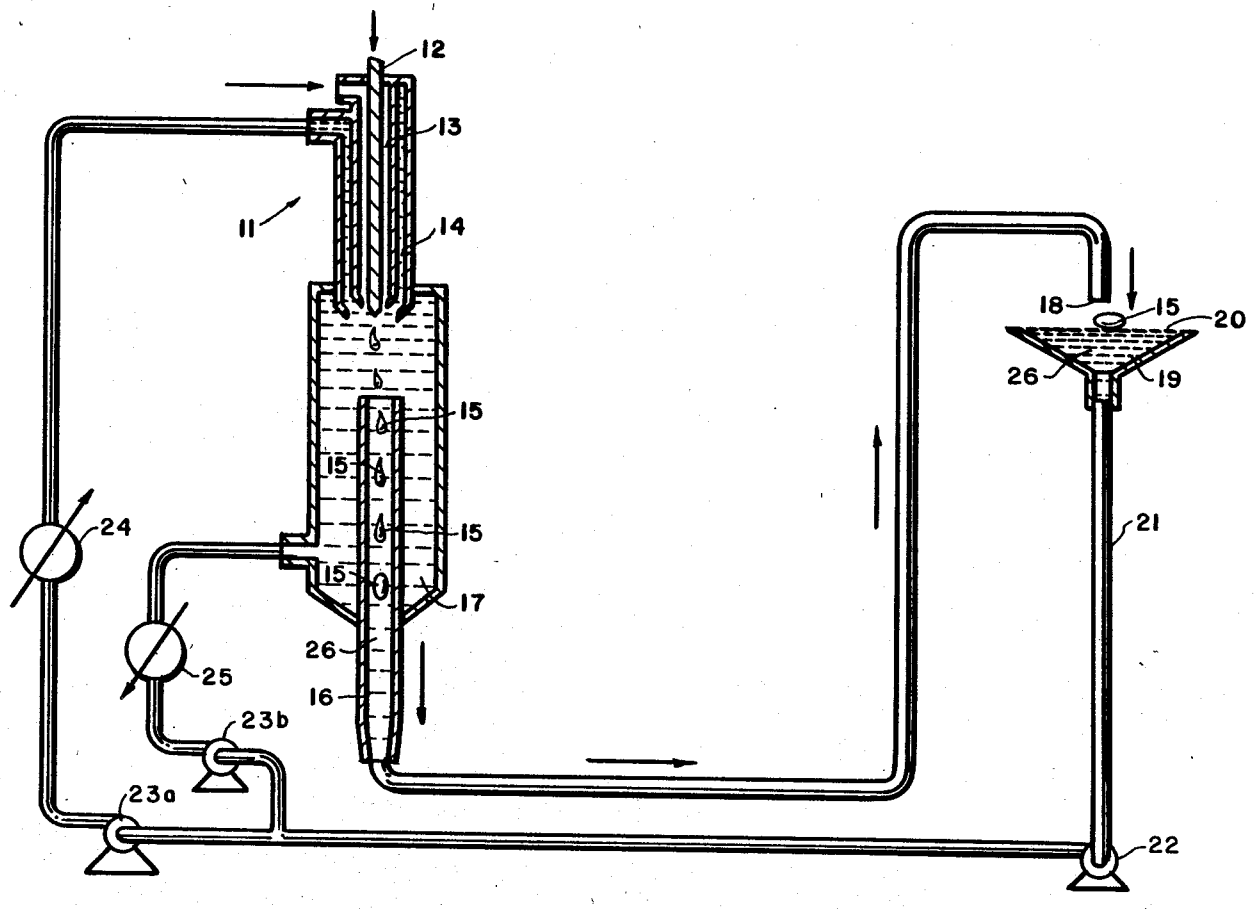

The present invention is fully understood by reference to the aforementioned patent to G. R. Somerville, as well as the FIGURE which is reproduced herein. The FIGURE illustrates, in schematic form, a laboratory flow process diagram for practice of the present invention. The extrusion nozzle 11 is of concentric form. It comprises a series of concentric passages for the various components of the intended microcapsule, as well as the carrier fluid. Passage 12 holds fill material. Passage 13, which surrounds passage 12, holds the fluid material intended to form the shell. Finally, passage 14 is adapted to hold and convey the carrier fluid 26. As can be seen in the FIGURE, the passage of fill, shell, and carrier fluids through the nozzle 11 results in the formation of microcapsules 15. These microcapsules are sent through conduit 16 which is placed in reservoir 17 which holds a cold carrier fluid which aids in the solidification of the fluid materials from passages 12 and 13 into the desired product. The carrier outlet 18 conveys the capsules to an appropriate collection tank 19 which can be covered by screen 20 for the collection of the capsules. The carrier fluid is recycled through line 21 by means of a centrifugal pump 22. Appropriate zenith pumps **23*a* and 23*b* can be used to convey one portion of the carrier through a heater 24 for recycle as a warm carrier fluid to the nozzle 11. The other portion can be conveyed through a chiller 25 to serve as the cold carrier fluid for reservoir 17**. For a dry basis production rate of approximately 1.27 lb./hr., it has been found that very good results are obtained using a fill material feed rate of 8.5 grams/minute at room temperature, a shell material rate of about 4.5 grams/minute at 105° F., a warm carrier fluid rate of about 20 grams/minute at 100° F., and a cold carrier rate of 0.5–0.6 liter/minute at 45° F.

The present invention is premised upon the discovery that the integrity of the shell of fluid filled microcapsules formed by the above process is significantly improved by the inclusion of an effective amount of a surfactant, having affinity for the carrier fluid, in the carrier fluid. When the carrier fluid is an oil-based carrier, e.g., mineral oil, it is necessary to use a lipophilic emulsifier such as a sorbitan ester-based surfactant, such as a monosorbitan ester of a long chain alkenoic acid, such as oleic acid. It has been found that weight percentages of surfactant, based on the weight of the carrier fluid, of from about 0.5% to about 3.0% are useful in accordance with the present invention.

Attempts to eliminate the problem of hole formation in the shell of the capsules by variation of the following parameters was unsuccessful: shell solids content; fill temperature; shell temperature; warm transport rate; cold carrier rate and composition; and nozzle size and configuration.

Further details regarding the present invention can be determined by reference to the Examples which follow, which represent certain embodiments thereof.

COMPARATIVE EXAMPLE 1

The apparatus used in the FIGURE was employed, without the presence of surfactant in the carrier fluid but with a surfactant in the shell material, in an attempt to form liquid filled microcapsules. The capsules broke in the collection tube.

The fill material was triglyceride. The major components of the shell material comprised:

26.4% 300 Bloom gelatin
3.6% Sodium cyclamate
70.0% Water

In addition, the following optional additives were used (all percentages based on the weight of the previously described essential ingredients):

0.12% FD and C Blue #1 Dye
0.33% Citric Acid
2.0% Block copolymer surfactant (PLURONIC F-68 brand)

The carrier composition comprised a 1:5 weight ratio of heavy mineral oil to isoparaffinic petroleum distillate solvent (ISOPAR E brand).

The shell and fill material temperatures were both 120° F. The warm carrier temperature was 130° F. The warm carrier feed rate was about 20 gm/min whereas the cold carrier feed rate was 0.5–0.6 liter/min.

EXAMPLE 2

This Example illustrates the present invention and was conducted using the same materials and conditions shown in Comparative Example 1 with the exception that the carrier composition contained 1% by weight of the monosorbitan ester of oleic acid (SPAN 80 brand) and no surfactant was used in the material intended to form the shell. The capsules appeared to have greater strength as evidenced by increased burst strength (over 10 lbs. Hunter mechanical force gauge) over capsules prepared without surfactant in the carrier fluid (under 5 lbs. Hunter mechanical force gauge).

EXAMPLES 3–11

A series of runs were made all using the following materials to form the shell:

22.25% 300 Bloom gelatin
0.50% Sodium Saccharin
2.25% Sorbitol
75.0% Water

Additional components were 0.18% FD and C Blue #1 dye and 0.33% citric acid (percentage basis were the previous four ingredients).

The fill material temperature was 67° F., the shell material temperature was 100° F., the warm carrier temperature was 95° F., and the cold carrier temperature was 45°–50° F.

The carrier composition comprises a 60/40 weight mixture of 210 SUS/70 SUS mineral oil with the amounts of monosorbitan ester of oleic acid (SPAN 80 brand) surfactant (wt % based on the carrier composition) listed in the Table set forth below. The Table also sets forth the feed rates of the shell and fill materials (in gm/min) and the results.

| Ex. | Fill | Shell Rate | Fill Rate | Surfactant | Remarks |
|---|---|---|---|---|---|
| 3 | Peppermint | 5.1 | 8.5 | 0.53% | Capsules formed at 87% of theoretical payload. Production rate: about 1.3 lb/hr |
| 4 | Menthol/mint | 5.1 | 8.5 | 0.53% | Same as 3 |
| 5 | Peppermint | 3.6 | 6.6 | 1% | Capsules formed OK Production rate: 1 lb/hr |
| 6 | Peppermint | 2.7 | 5.0 | 1% | Capsules formed OK Production rate: 0.75 lb/hr |
| 7 | Citrus/mint | 2.7 | 5.0 | 1% | Capsules formed OK Production rate: 0.75 lb/hr |
| 8 | Wintergreen/ Alcohol | 2.7 | 5.0 | 1% | Capsules did not form |
| 9 | Peppermint | 5.1 | 8.5 | 1% | Bottom collection - 8 ft drop. Some capsules formed but air was pulled into the system by negative pressures. |
| 10 | Peppermint | * | * | * | Bottom collection. Needle valve controls on shell and fill. Surfactant levels were varied. Feed rates were very difficult to control with the needle valve. |
| 11 | Peppermint | * | * | 2% | Top collection. Obtained production rates were 0.75, 1.27, 1.6, and 2.88 lb/hr. Good capsules formed at the lower two rates. Higher rates increased the number of leakers. |

*indicates variable rates/amounts were used.

EXAMPLE 12

The same shell material and temperature conditions utilized in Examples 3–11 was used with a peppermint oil fill material, a 70 SUS mineral oil carrier containing 3% surfactant (SPAN 80 brand) at a shell feed rate of 6.0 gm/min and a fill feed rate of 10.0 gm/min.

The capsules were bottom collected after a twelve foot drop. The quality was no better than the capsules obtained in Example 9.

DISCUSSION OF THE EXAMPLES

First (Comparative Example 1), a surfactant was added to the shell material resulting in capsule breakage in the carrier fluid. SPAN 80 surfactant (from ICI Americas) was then added to the carrier fluid (Example 2) yielding a much improved capsule. A definite difference could be seen in the capsule formation with and without surfactant in the carrier fluid. Without surfactant, the capsules broke abruptly into droplets in the carrier stream, whereas with a surfactant in the carrier the capsules "strung out" with a very thin filament between the capsules before breaking into droplets. Different levels of SPAN 80 surfactant were studied indicating that a level of 0.5% was the maximum needed for acceptable capsule formation. During this time period, samples of peppermint and menthol-mint capsules were prepared (Examples 3 and 4). Attempts to encapsulate an alcohol-based flavor (Example 8) proved unsuccessful due to the miscibility of the alcohol and the water in the shell.

A series of runs (Example 11) were made to determine the effect of production rates on the quality of the capsules. Rates of 0.75, about 1.3, 1.6, and about 2.9 lb/hr/nozzle (dry basis) indicated that above rates of about 1.3 lb/hr the quality of the capsules produced decreased.

Capsules prepared by the submerged nozzle apparatus and using SPAN 80 surfactant in the carrier fluid yielded a capsule vastly superior to capsules prepared earlier in the program using the stationary extrusion method. The submerged nozzle and stationary extrusion nozzle apparatus (also termed "simple extrusion" apparatus) are shown at pages 161 and 60, respectively, of the Vandegaer reference mentioned earlier. However, some wall deformation was still presenting problems. It was felt that capsule deformation could possibly be occurring by collisions on the capsule in the horizontal section of the carrier flue line. In order to test this theory, the system was modified so that the capsules could be collected directly from the bottom of the carrier fluid line such that the capsules would be prevented from colliding. (These runs are identified as Examples 9–10 and 12.) Difficulties were encountered with air being sucked into the system because of the negative pressure created by the bottom collection. Few runs were made of a long enough duration to properly evaluate the system. Capsules which were collected did not show a significant improvement over previously prepared capsules. During the course of above experiments with the submerged nozzle apparatus, carrier fluids consisting of ISOPAR E solvent, heavy mineral oil, light mineral oil and combinations of these were used. If the carrier viscosity is too low, such as with pure ISOPAR E solvent, too much turbulence is created in the carrier causing capsule size variation. The most preferred carrier fluids ranged from 100% 70SUS mineral oil to a 60/40 mixture of 210SUS and 70SUS mineral oils.

The foregoing Examples and descriptive material are presented for illustration only and should not be construed in a limiting sense. The scope of protection desired is set forth in the claims which follow.

We claim:

1. A method of improving the integrity of the seamless shell of a round, fluid filled, microcapsule formed by the simultaneous extrusion, from coaxially aligned and concentric extrusion nozzles into a surrounding carrier fluid moving in the direction of the extrusion, of (1) a fluid filler material, which is immiscible with a hardenable fluid material used in forming the shell, and (2) said hardenable fluid material used in forming the shell, which method comprises introducing into the carrier fluid an effective amount of a surfactant having affinity with the carrier fluid to improve the integrity of the shell of the microcapsule upon hardening of the fluid material used in forming the shell.

2. A method as claimed in claim 1 wherein the amount of surfactant used ranges from about 0.5% to about 3.0%, by weight of the carrier fluid.

3. A method as claimed in claim 1 wherein the carrier fluid is an oil-based carrier fluid and the surfactant is a sorbitan ester surfactant.

4. A method as claimed in claim 2 wherein the carrier fluid is an oil-based carrier fluid and the surfactant is a sorbitan ester surfactant.

5. A method as claimed in claim 4 wherein the surfactant is a monosorbitan ester of a fatty acid type alkenoic acid.

6. A method as claimed in claim 5 wherein the acid is oleic acid.

* * * * *